US011001936B2

(12) United States Patent
Hotta et al.

(10) Patent No.: US 11,001,936 B2
(45) Date of Patent: May 11, 2021

(54) SURFACE TREATING DEVICE

(71) Applicant: C. Uyemura & Co., Ltd., Osaka (JP)

(72) Inventors: Teruyuki Hotta, Osaka (JP); Kouji Shimizu, Osaka (JP); Masayuki Utsumi, Osaka (JP); Masato Aratani, Tokyo (JP)

(73) Assignee: C. Uyemura & Co., Ltd., Osaka (JP)

( * ) Notice: Subject to any disclaimer, the term of this patent is extended or adjusted under 35 U.S.C. 154(b) by 156 days.

(21) Appl. No.: 16/252,903

(22) Filed: Jan. 21, 2019

(65) Prior Publication Data

US 2019/0301048 A1 Oct. 3, 2019

(30) Foreign Application Priority Data

Mar. 29, 2018 (JP) ..... JP2018-064846

(51) Int. Cl.
*C25D 17/18* (2006.01)
*C25D 21/18* (2006.01)
*C25D 5/04* (2006.01)

(52) U.S. Cl.
CPC ..... *C25D 17/18* (2013.01); *C25D 5/04* (2013.01); *C25D 21/18* (2013.01)

(58) Field of Classification Search
None
See application file for complete search history.

(56) References Cited

U.S. PATENT DOCUMENTS 4,445,993 A * 5/1984 Stutz ..... C25D 17/20 204/213
5,487,824 A 1/1996 Griego
6,562,217 B1 5/2003 Tanaka et al.
7,837,840 B2 11/2010 Sugiura et al.
(Continued)

FOREIGN PATENT DOCUMENTS

DE 3047984 A1 8/1982
JP S55-102964 U1 7/1980
JP S59-74815 U 5/1984
(Continued)

OTHER PUBLICATIONS

Notification of Reasons for Refusal (Including Translation) for Japanese Patent Application No. 2018-064846, dated Mar. 30, 2020.
(Continued)

*Primary Examiner* — Stefanie S Wittenberg
(74) *Attorney, Agent, or Firm* — Jason H. Vick; Sheridan Ross, PC

(57) ABSTRACT

A rotational surface treating device with a high treatment efficiency that allows a treatment liquid to be discharged in a short time is provided. When a treatment bath 2 is rotated, parts 20 contact an electrode 50 to be electroplated. In this event, a plating liquid 16 is used as circulated by a pump P. The plating liquid 16 is discharged to the outside through a gap in a side wall 80 for replacement of the plating liquid 16 or the like. During discharge, the plating liquid 16 is not circulated by the pump P. The gap 8 which is formed in the side wall 80 is formed to be smaller than the minimum
(Continued)

dimension of the parts 20 on the inner side. The gap 8 is formed to be wider toward the outer side. Thus, water is discharged immediately.

6 Claims, 17 Drawing Sheets

(56) References Cited

U.S. PATENT DOCUMENTS

2009/0301888 A1 12/2009 Sugiura et al.

FOREIGN PATENT DOCUMENTS

| | | | |
|---|---|---|---|
| JP | H11-172495 | | 6/1999 |
| JP | 2004-267980 | A | 9/2004 |
| JP | 2004-300470 | A | 10/2004 |
| JP | 2011-174157 | A | 9/2011 |
| JP | 4832970 | B2 | 12/2011 |
| WO | WO 2008/081536 | | 7/2008 |

OTHER PUBLICATIONS

Notification of Reasons for Refusal (Including Translation) for Japanese Patent Application No. 2018-064846, dated Nov. 4, 2020.

* cited by examiner

FIG.14A

| RELATED-ART STRUCTURE (FIG.13B) | PRESENT INVENTION STRUCTURE (FIG.13A) |
|---|---|
| 0.29L/min | 4.79L/min |

FIG.14B

| PRESENT INVENTION STRUCTURE (FIG.15A) | PRESENT INVENTION STRUCTURE (FIG.13A) | PRESENT INVENTION STRUCTURE (FIG.15B) |
|---|---|---|
| 3.43L/min | 4.79L/min | 4.78L/min |

SURFACE TREATING DEVICE

CROSS REFERENCE TO RELATED APPLICATIONS

This application claims the benefit under 35 U.S.C. 119(a) to Japanese Patent Application No. JP 2018-064846, filed Mar. 29, 2018, the entire disclosure of which is incorporated herein by reference in its entirety.

BACKGROUND OF THE INVENTION

1. Field of the Invention

The present invention relates to a device that performs a surface treatment by rotating objects to be treated together with a treatment liquid such as a plating liquid.

2. Description of the Related Art

A rotational surface treating device is used to plate a large number of small parts and the like. FIG. 17 illustrates a rotational surface treating device disclosed in Patent Document 1 (Japanese Patent No. 4832970).

A treatment bath 2 is provided in an outer housing 18. The treatment bath 2 includes a bottom surface member 4, a side wall 6, and a cover member 14. A rotary shaft 10 to be rotated by a motor (not illustrated) is coupled to the lower portion of the treatment bath 2, whereby the treatment bath 2 is also rotated.

A treatment liquid 16 and a large number of parts 20 to be plated (to be treated) are input into the treatment bath 2. A first electrode 12 is provided to contact the treatment liquid 16.

When the treatment bath 2 is rotated, the parts 20 are collectively pressed onto the side wall 6 by a centrifugal force. The side wall 6 also serves as a second electrode, and plating can be applied to the parts 20 by energizing between the first electrode 12 and the side wall 6.

A gap 8 is provided between the bottom surface member 4 and the side wall 6. The gap 8 is formed to be slightly smaller than the minimum dimension of the parts 20. Thus, the parts 20 stay in the treatment bath 2 while the treatment liquid 16 is discharged to the outside through the gap 8 by the centrifugal force.

The treatment liquid 16 which is discharged out of the treatment bath 2 is returned to the treatment bath 2 again by a pump P. In this manner, the treatment liquid 16 in the treatment bath 2 is circulated so that a new treatment liquid 16 is always supplied to the parts 20.

To change the type of the treatment liquid 16, meanwhile, the treatment bath 2 is rotated to discharge the treatment liquid 16 to the outside via the gap 8.

In the rotational surface treating device according to the related art such as that described above, however, it takes time to discharge the treatment liquid 16 through the gap 8 to replace the treatment liquid 16 or the like, and it is difficult to improve the treatment efficiency.

In the case where the parts 20 are minute (e.g. metal balls (metal powder) with a diameter of 30 μm), in particular, the gap 8 must be so small that it takes a long time to discharge the treatment liquid 16.

The present invention has been made in view of the foregoing issue, and therefore has an object to provide a rotational surface treating device with a high treatment efficiency that allows a treatment liquid to be discharged in a short time.

SUMMARY OF THE INVENTION

Several independent features of the present invention will be enumerated below.

(1) The present invention provides a rotational treating device including: a treatment bath that has a side wall and a bottom surface and that accommodates a treatment liquid and objects to be treated; and a rotating mechanism that rotates the treatment bath such that the objects to be treated receive a centrifugal force toward the side wall, in which: the side wall is provided with a gap that allows the treatment liquid to be discharged by the centrifugal force due to rotation of the treatment bath; and the gap is formed to be smaller than a minimum outer dimension of the objects to be treated on an inner side contacted by the objects to be treated, and formed to be larger on an outer side.

Thus, it is possible to increase the discharge rate of the treatment liquid, which improves the treatment efficiency.

(2) The present invention provides the rotational treating device, in which: the side wall is constituted by stacking hollow disks on each other; and the gap is formed by interposing a spacer between adjacent hollow disks, and the hollow disks are formed to be thinner on the outer side than on the inner side.

Thus, it is possible to easily achieve a structure that can increase the discharge rate of the treatment liquid.

(3) The present invention provides the rotational treating device, in which the side wall is constituted by disposing wedge-shaped members with wider portions of the wedge-shaped members directed inward and fixing the wedge-shaped members to a support member with a gap provided between adjacent wedge-shaped members.

Thus, it is possible to easily achieve a structure that can increase the discharge rate of the treatment liquid.

(4) The present invention provides a rotational treating device including: a treatment bath that has a side wall and a bottom surface and that accommodates a treatment liquid and objects to be treated; and a rotating mechanism that rotates the treatment bath such that the objects to be treated receive a centrifugal force toward the side wall, in which: the side wall is provided with a gap that allows the treatment liquid to be discharged by the centrifugal force due to rotation of the treatment bath; and a porous member is provided in the gap on at least an inner side contacted by the objects to be treated, and the gap is formed to be larger on an outer side.

Thus, it is possible to increase the discharge rate of the treatment liquid, which improves the treatment efficiency.

(5) The present invention provides a rotational treating device including: a treatment bath that has a side wall and a bottom surface and that accommodates a treatment liquid and objects to be treated; and a rotating mechanism that rotates the treatment bath such that the objects to be treated receive a centrifugal force toward the side wall, in which: the side wall is provided with a gap that allows the treatment liquid to be discharged by the centrifugal force due to rotation of the treatment bath; and a length of the side wall, which has the gap, from an inner side to an outer side is equal to or less than 50 times an average diameter of the objects to be treated.

Thus, it is possible to increase the discharge rate of the treatment liquid, which improves the treatment efficiency.

(6) The present invention provides the rotational treating device, in which: a second electrode is provided as at least a part of the side wall; and a first electrode is provided so as to contact the treatment liquid.

Thus, the present invention is applicable to devices that perform an electrical treatment.

(7) The present invention provides a ring-shaped member that constitutes a side wall of a treatment bath that has the side wall and a bottom surface and that accommodates a treatment liquid and objects to be treated, in which a recessed portion that facilitates discharge of the treatment liquid is provided to extend from an outer peripheral end to a location before an inner peripheral end of the ring-shaped member.

Thus, it is possible to provide a ring-shaped member that can increase the discharge rate of the treatment liquid.

The features of the present invention can be described broadly as set forth above. The structures and characteristics of the present invention will be apparent from the following detailed description of the invention together with those features, effects, and drawings.

BRIEF DESCRIPTION OF THE DRAWINGS

FIGS. 14A and 14B illustrate experiment result data;

DESCRIPTION OF THE PREFERRED EMBODIMENTS

Figure 1:
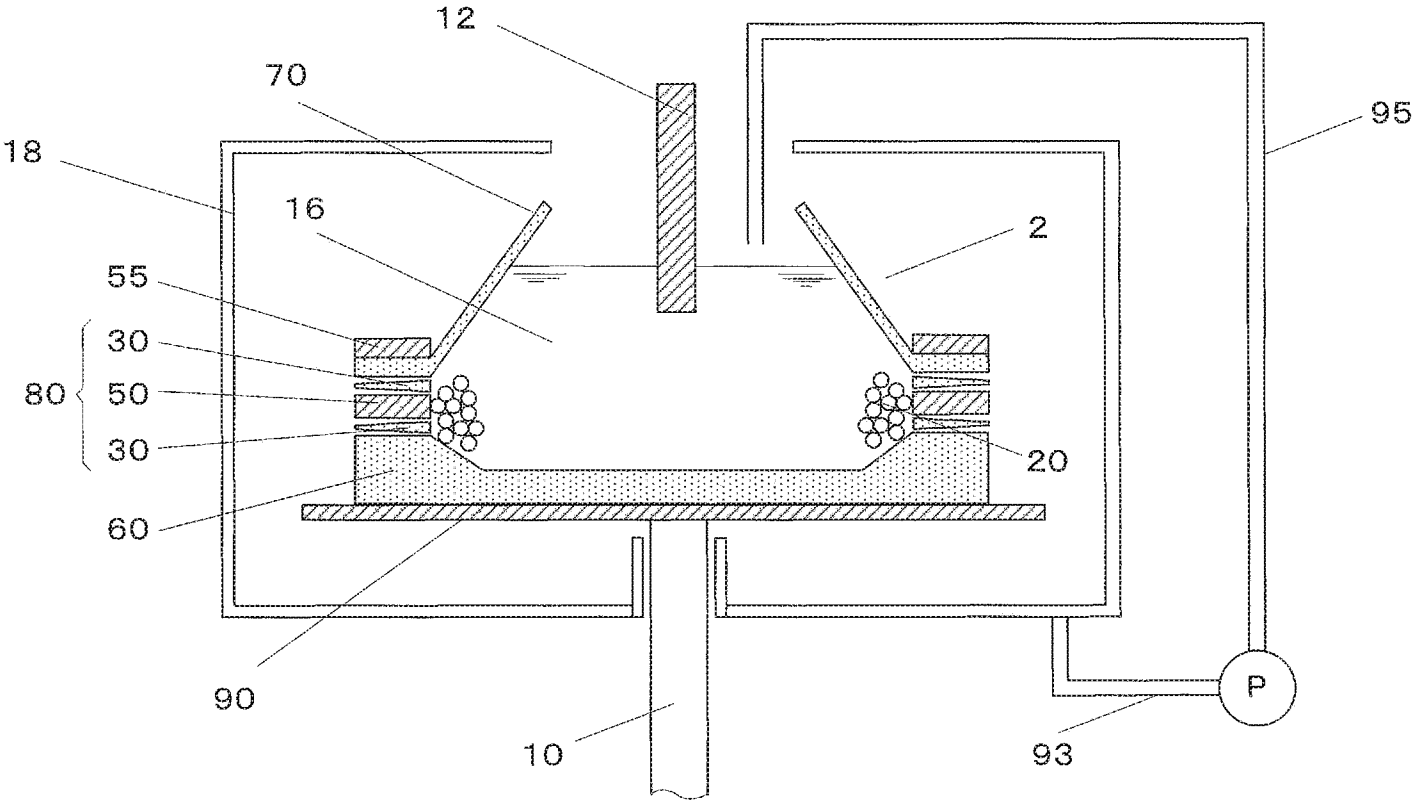
FIG. 1 is a sectional view of a rotational treating device according to an embodiment of the present invention.

FIG. 1 is a sectional view of a rotational surface treating device according to an embodiment of the present invention.

A treatment bath 2 is provided in an outer housing 18. The treatment bath 2 includes a bottom surface member 60, a side wall 80, and a cover member 70. The treatment bath 2 is placed on a base member 90 made of metal to be fixed.

The base member 90 is rotated by a rotary shaft 10 that is rotated by a motor (not illustrated). Thus, the treatment bath 2 is also rotated together. A treatment liquid 16 that serves as a treatment liquid and parts 20 to be treated are input into the treatment bath 2. An anode 12 that serves as a first electrode is immersed in the upper portion of the plating liquid 16.

The side wall 80 is constituted by stacking a lower slit ring 30, a cathode ring 50 that serves as a second electrode, and an upper slit ring 30 on each other. A washer is inserted into a space between any two of the bottom surface member 60, the lower slit ring 30, the cathode ring 50, the upper slit ring 30, and the cover member 70 which are stacked on each other. Thus, a slight gap is formed between such components.

When the treatment bath 2 is rotated, the parts 20 are pressed toward the side wall 80 by a centrifugal force. In that event, the parts 20 which abut against the cathode ring 50 of the side wall 80 are electroplated by a current from the anode 12. The parts 20 are moved along with rotation of the treatment bath 2 (particularly, in the case where the treatment bath 2 is rotated in reverse), which allows the parts 20 to be plated.

During rotation, the plating liquid 16 is discharged to the outside through the gaps in the side wall 80 to be accumulated in the lower portion of the outer housing 18. The plating liquid 16 is introduced into a pump P by way of a recovery pipe 93. The pump P feeds the plating liquid 16 which has been recovered to a resupply pipe 95. The distal end of the resupply pipe 95 is disposed over the treatment bath 2. Thus, the plating liquid 16 is used in circulation.

To change the type of the plating liquid 16 or the like, meanwhile, the plating liquid 16 is discharged (through a discharge pipe (not illustrated)), rather than being circulated by the pump P.

In the embodiment, the following configuration is adopted in order to increase the rate at which the plating liquid 16 is discharged from the treatment bath 2. As discussed earlier, the side wall 80 of the treatment bath 2 is formed by stacking the various members on each other. The various members will be described below in the stacking order.

Figure 2C:
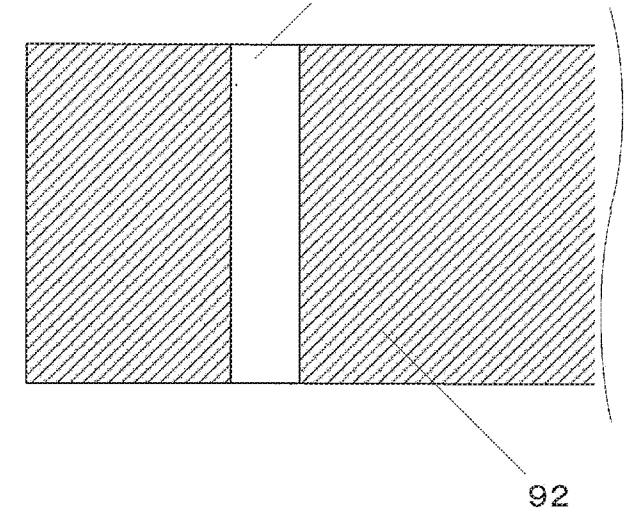
FIGS. 2A to 2C illustrate the details of a base member 90.
Figure 2A:
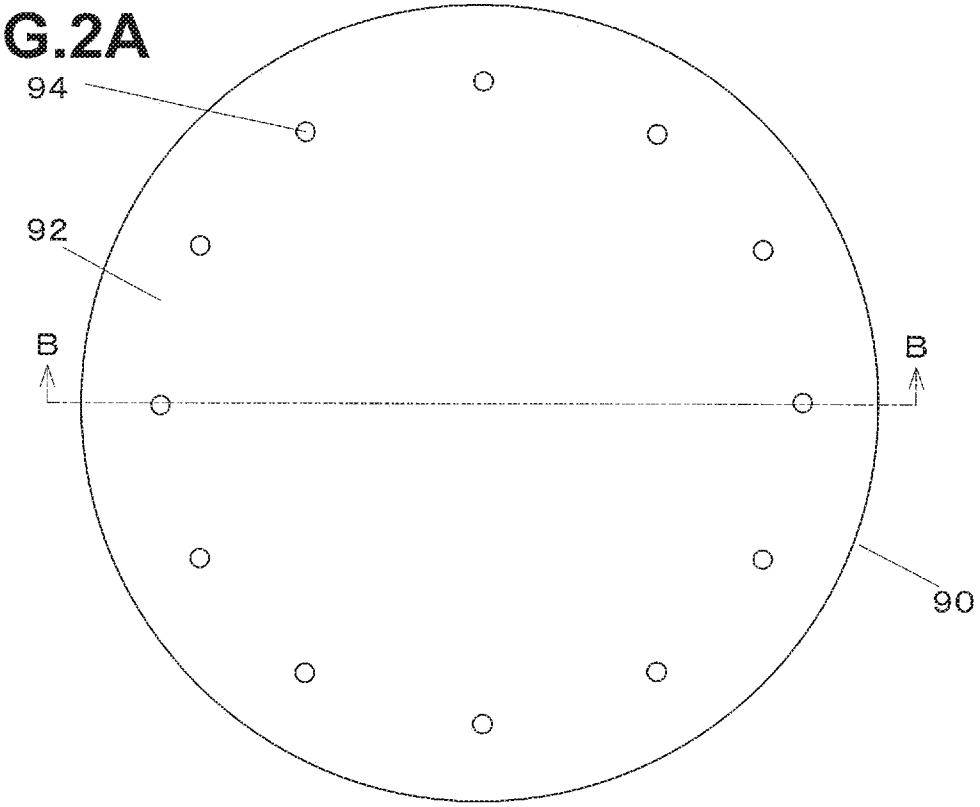
Figure 2B:
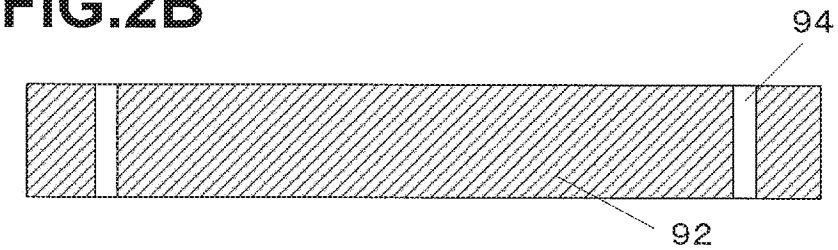

FIG. 2 illustrates the details of the base member 90. FIG. 2A is a plan view, FIG. 2B is a side sectional view, and FIG. 2C is an enlarged sectional view. The base member 90 holds and rotates the treatment bath 2. The base member 90 is constituted of a disk 92 made of conductive metal. Through holes 94 for fixation of the treatment bath 2 are provided in the vicinity of the outer periphery of the disk 92.

Figure 3A:
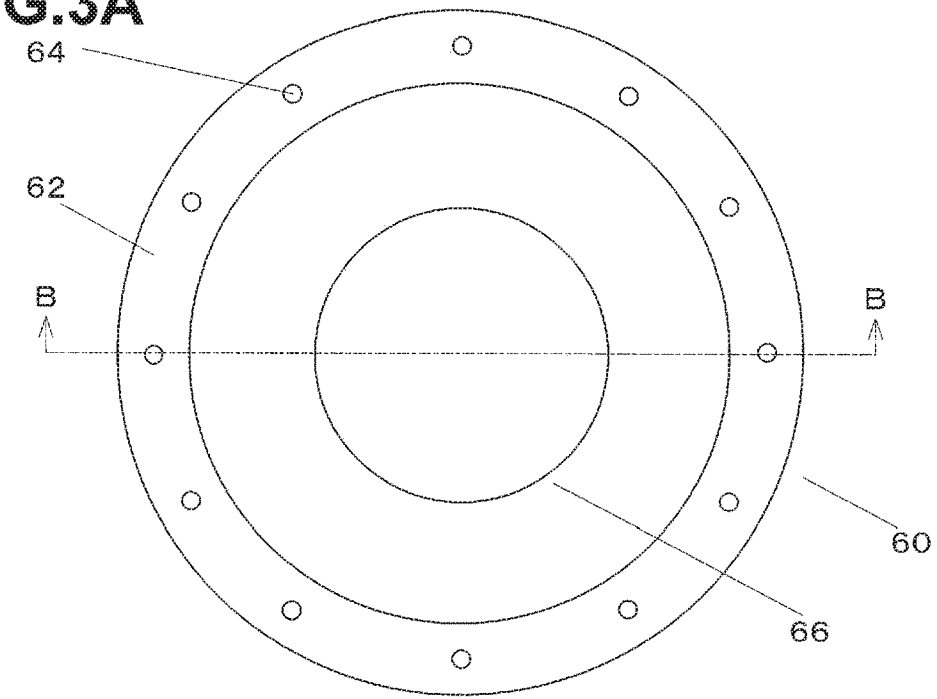
FIGS. 3A to 3C illustrate the details of a bottom surface member 60.
Figure 3B:
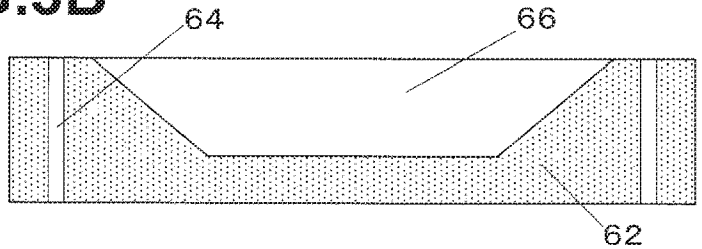
Figure 3C:
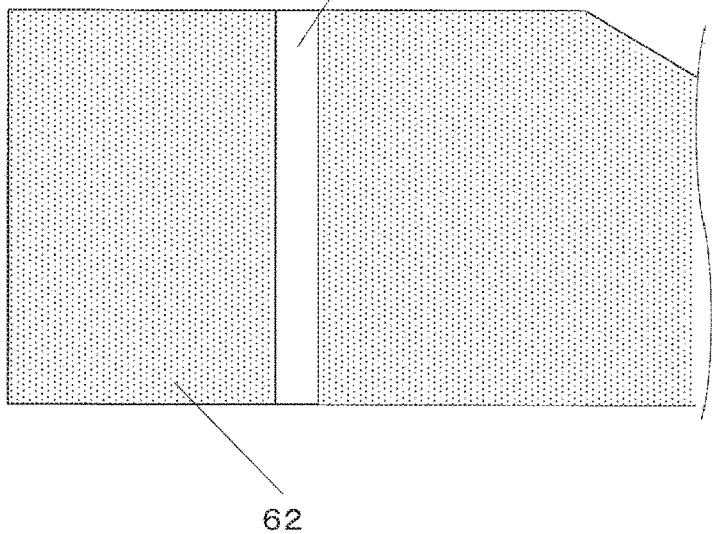

FIG. 3 illustrates the details of the bottom surface member 60 which is placed on the base member 90. FIG. 3A is a plan view, FIG. 3B is a side sectional view, and FIG. 3C is an enlarged sectional view. The base member 90 is constituted of a disk 62 made of a non-conductive resin. A recessed portion 66 for retention of the parts 20 is provided at the center portion of the disk 62. Through holes 64 are provided in the vicinity of the outer periphery of the disk 62 at positions corresponding to the through holes 94 of the disk 92. The members can be fixed to each other by inserting bolts (not illustrated) into the through holes 94, 64, . . . and screwing nuts (not illustrated) to the bolts.

Figure 4B:
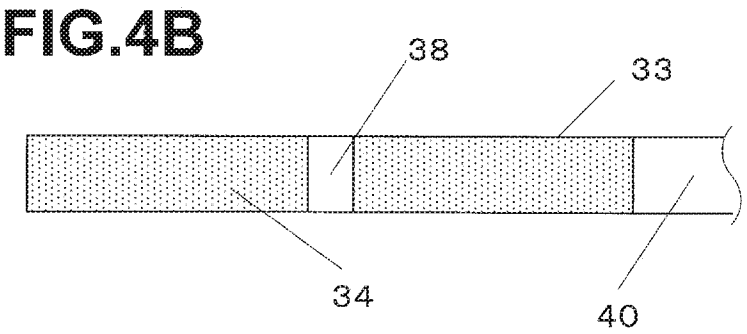
FIGS. 4A to 4C illustrate the details of a slit ring 30.
Figure 4C:
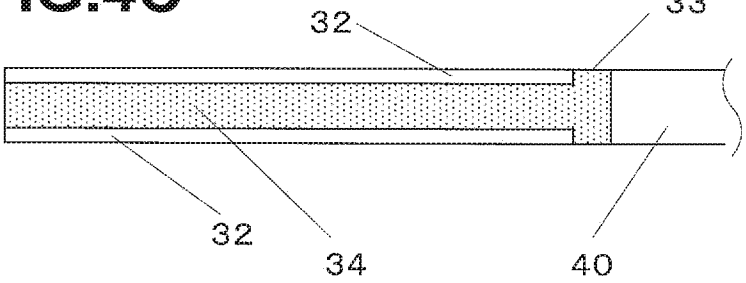
Figure 4A:
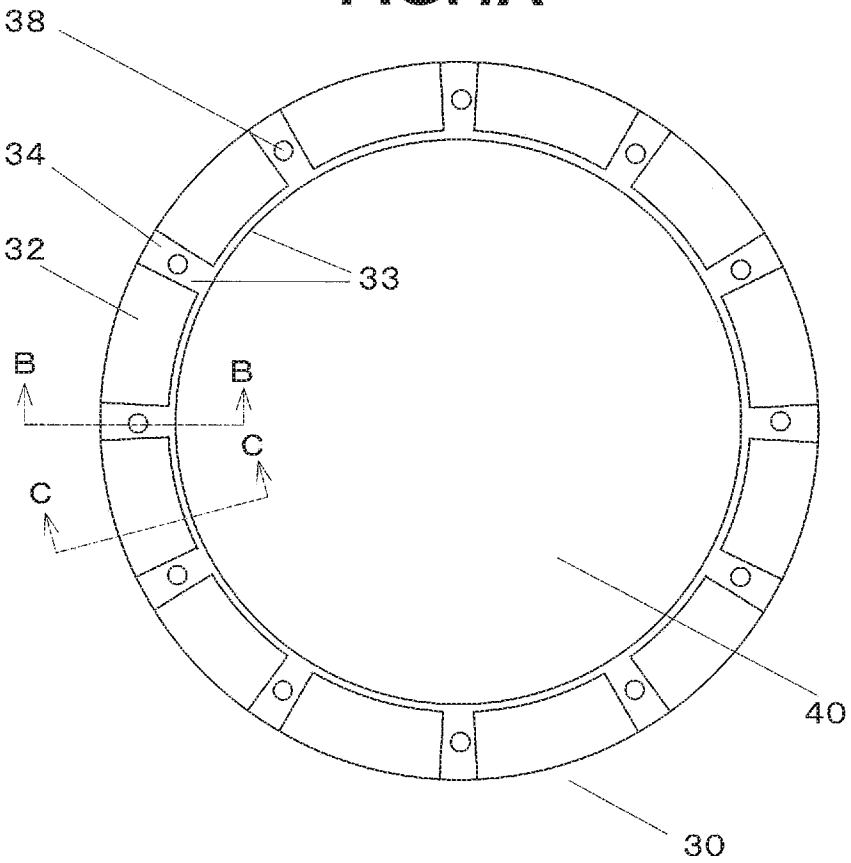

FIG. 4 illustrates the details of the slit ring 30 which is placed on the bottom surface member 60. FIG. 4A is a plan view, and FIGS. 4B and 4C are each an enlarged sectional view. The slit ring 30 is constituted of a ring-shaped disk 34 having a large opening 40 in its center portion and made of a non-conductive resin. Through holes 38 are provided in the ring-shaped disk 34 at positions corresponding to the through holes 64 of the bottom surface member 60.

As seen from FIG. 4B which illustrates the B-B section in FIG. 4A, the ring-shaped disk 34 is formed to have a thickest portion 33, in which the thickness of the ring-shaped disk 34 is largest, in the vicinity of the through hole 38.

Recessed portions 32 are provided between adjacent through holes 38. As seen from FIG. 4C which illustrates the C-C section in FIG. 4A, the recessed portions 32 are formed to extend all the way from the thickest portion 33 on the inner side toward the outer periphery. The recessed portions 32 are provided on both the upper and lower surfaces. In the embodiment, the recessed portions 32 have a depth of about 0.5 mm.

Figure 5A:
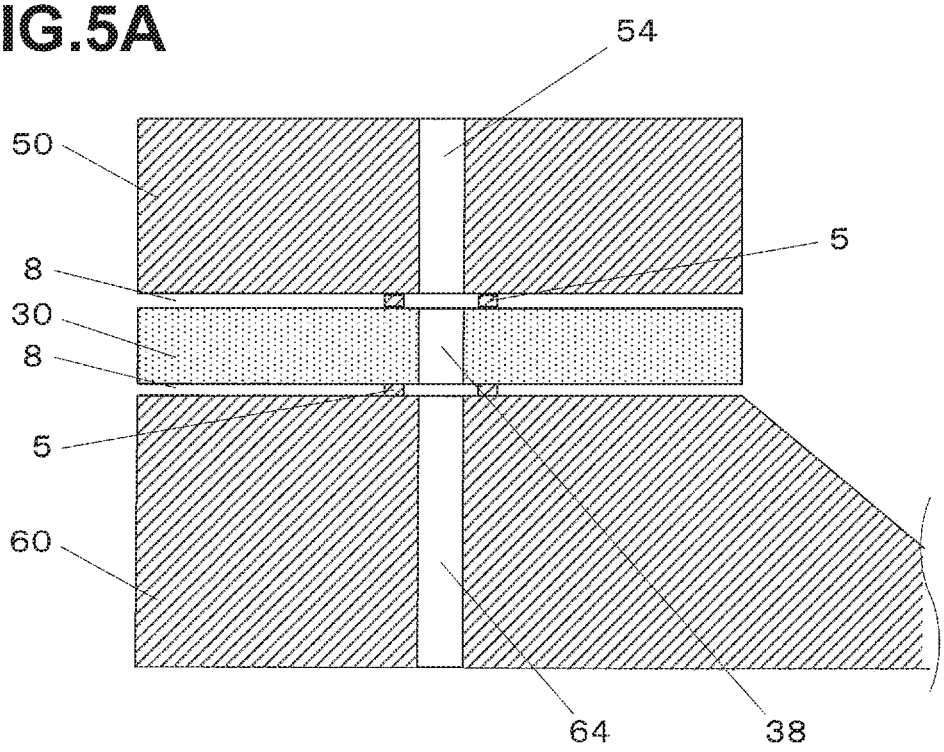
FIGS. 5A and 5B illustrate the slit ring 30 in an attached state.

When placing the slit ring 30 on the bottom surface member 60 to be fixed, as illustrated in FIG. 5A (end surface view), a spacer ring 5 is interposed around the through hole 38. Thus, a gap 8 corresponding to the thickness of the spacer ring 5 is formed between the bottom surface member 60 and the spacer ring 30.

In the embodiment, the gap 8 with a size of 30% to 80% (preferably 40% to 60%) of the minimum dimension (the smallest of the length, width, and height) of the parts 20 to be treated is formed. Consequently, only the plating liquid 16, not the parts 20, is discharged through the gap 8.

Figure 5B:
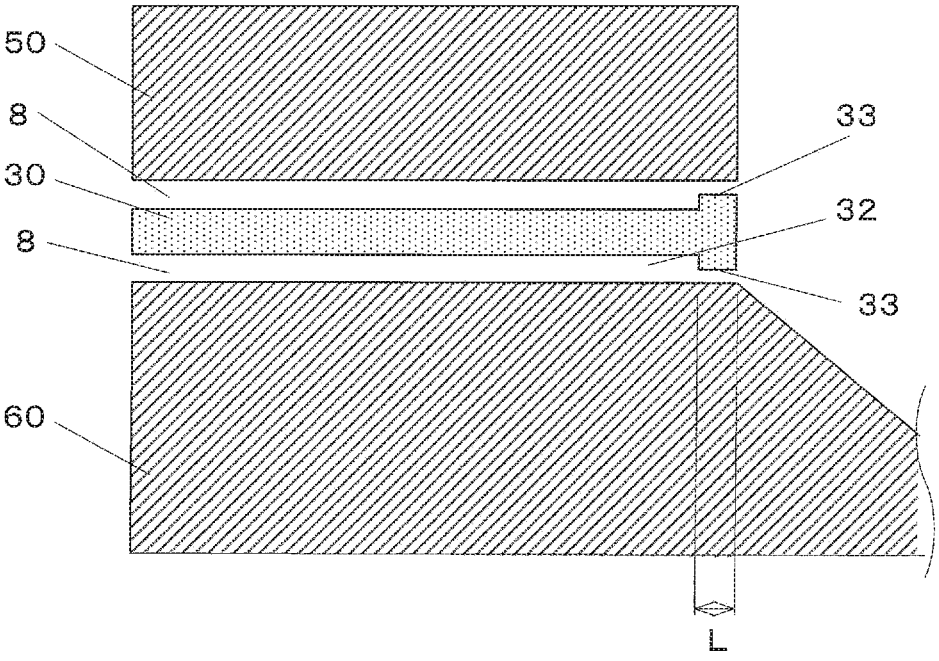

As illustrated in FIG. 5B (end surface view), the gap 8 is widened for the depth of the recessed portion 32 in a portion of the slit ring 30 in which the recessed portion 32 is formed. That is, the gap 8 is formed to be wider toward the outer side. Thus, the plating liquid 16 is discharged immediately, which improves the discharge rate. In the inside portion of the treatment bath 2, the thickest portion 33 is provided to narrow the gap 8, and thus the parts 20 are not discharged.

A length L of the thickest portion 33 in FIG. 5B is preferably as small as possible. In the embodiment, the length L is 2 mm in consideration of the balance with the strength.

Figure 6B:
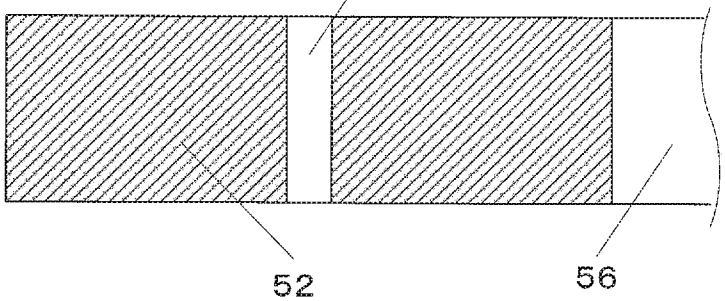
FIGS. 6A and 6B illustrate the details of a cathode ring 50.
Figure 6A:
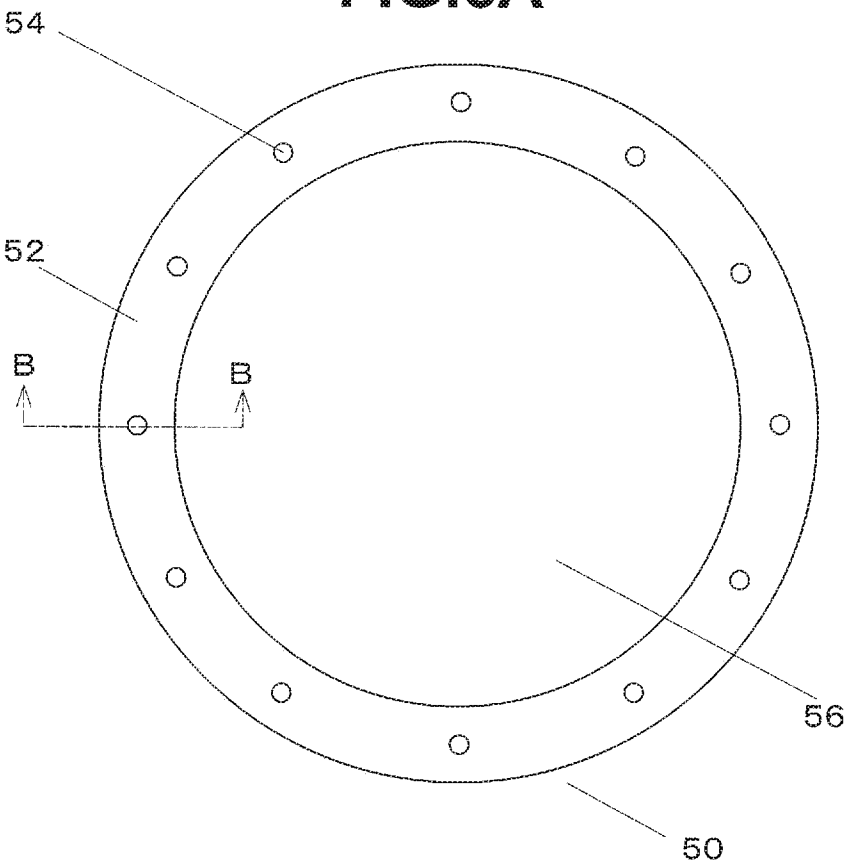

FIG. 6 illustrates the details of the cathode ring 50 which is placed on the slit ring 30. FIG. 6A is a plan view, and FIG. 6B is an enlarged sectional view. The cathode ring is constituted of a ring-shaped disk 52 having a large opening 56 in its center portion and made of conductive metal. Through holes 54 are provided in the ring-shaped disk 52 at positions corresponding to the through holes 38 of the slit ring 30.

When placing the cathode ring 50 on the slit ring 30 to be fixed, as illustrated in FIG. 5A (end surface view), a spacer ring 5 is interposed around the through hole 38. Thus, a gap 8 corresponding to the thickness of the spacer ring 5 is formed between the cathode ring 50 and the slit ring 30.

In the embodiment, the gap 8 with a size of 30% to 80% (preferably 40% to 60%) of the minimum dimension (the smallest of the length, width, and height) of the parts 20 to be treated is formed. Consequently, only the plating liquid 16, not the parts 20, is discharged through the gap 8.

As illustrated in FIG. 5B (end surface view), the gap 8 is widened for the depth of the recessed portion 32 in a portion of the slit ring 30 in which the recessed portion 32 is formed. Thus, the plating liquid 16 is discharged immediately, which improves the discharge rate. In the inside portion of the treatment bath 2, the thickest portion 33 is provided to narrow the gap 8, and thus the parts 20 are not discharged.

In the embodiment, as illustrated in FIG. 1, the slit ring 30 is placed also on the cathode ring 50. Also in this event, similarly, the gap 8 is formed with the spacer ring 5 interposed, and the gap 8 is formed to be widened by the recessed portion 32 of the slit ring 30.

Figure 7C:
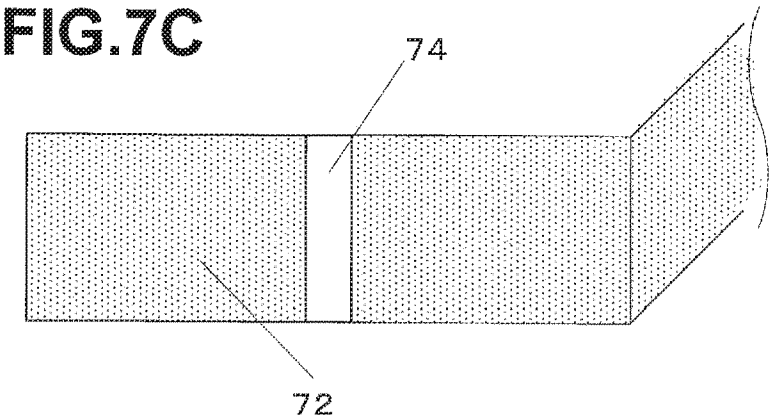
FIGS. 7A to 7C illustrate the details of a cover member 70.
Figure 7A:
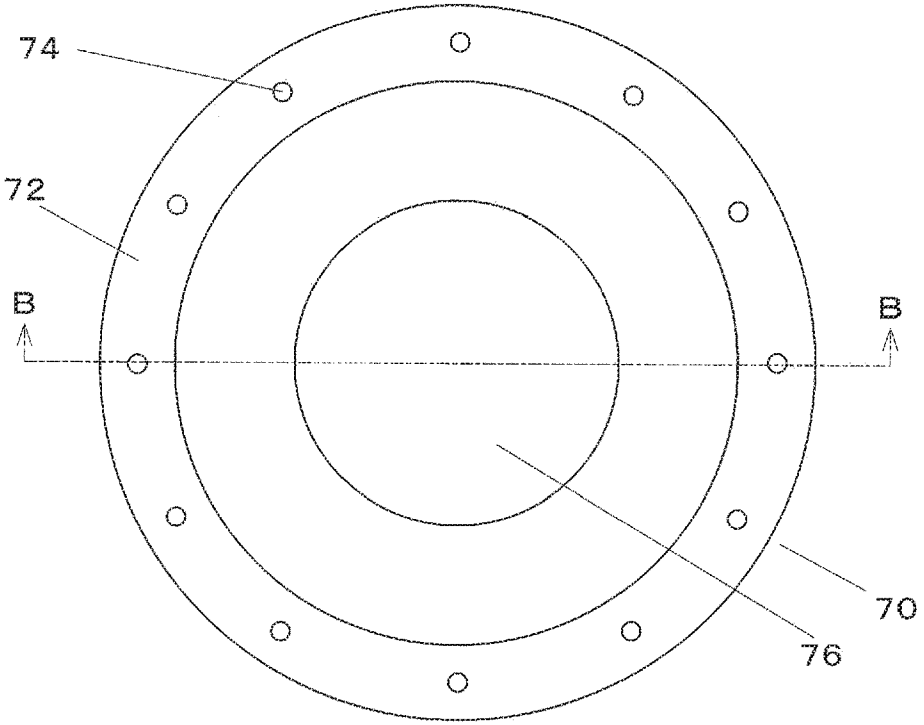
Figure 7B:
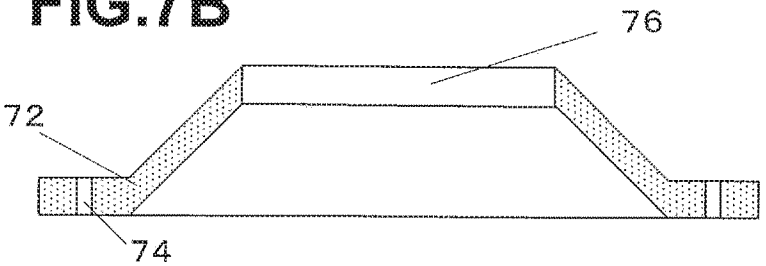

FIG. 7 illustrates the details of the cover member 70 which is placed on the upper slit ring 30. FIG. 7A is a plan view, FIG. 7B is a sectional view, and FIG. 7C is an enlarged sectional view. The cover member 70 is constituted of a lid-shaped doughnut member 72 made of a non-conductive resin. The lid-shaped doughnut member 72 is a cover that is flat at the outer peripheral portion and that is inclined toward the center portion. An opening 76 is provided in the center portion. Through holes 74 are provided in the flat portion at the outer periphery at positions corresponding to the through holes 38 of the slit ring 30.

The cover member 70 covers the treatment bath 2 such that the plating liquid 16 inside the treatment bath 2 does not splash out upward during rotation.

A spacer ring 5 is interposed also when the cover member 70 is placed on the slit ring 30 to be fixed. As at other locations, the gap 8 is formed by the spacer ring 5, and the gap 8 is formed to be widened by the recessed portion 32 of the slit ring 30.

A retention ring 55 is provided on the cover member 70. The retention ring 55 has the same shape as the cathode ring 50, however it is not electrically connected thereto.

The bolts (not illustrated) which penetrate the through holes in the various members are constituted of a conductive material. Consequently, the cathode ring 50 is electrically connected to the base member 90. A cathode potential is supplied to the base member 90 via the rotary shaft 10. An anode potential is supplied to the anode 12.

In the embodiment, as has been described above, the gap 8 which is formed in the side wall 80 is formed to be smaller than the minimum outer dimension of the parts 20 on the inner side, and to become larger toward the outer side. Consequently, water can be drained immediately with less resistance against drainage compared to a case where a long narrow gap continues.

(1) In the embodiment described above, the gap 8 is provided by the spacer ring 5. However, the gap 8 may be formed by providing a member such as the slit ring 30 with a protrusion corresponding to a spacer ring.

Alternatively, the slit ring 30 may be configured as illustrated in FIG. 16 to eliminate the need for the spacer ring 5. FIG. 16A is a plan view, and FIGS. 16B and 16C are each an enlarged sectional view. FIG. 16D is a further enlarged sectional view of the vicinity of the inner peripheral portion in FIG. 16C. As illustrated in FIG. 16B, the thickest portion 33 is formed to extend from the inner periphery to the outer periphery in the vicinity of the through hole 38. Recessed portions 32 are provided between adjacent through holes 38 as in FIG. 4.

Figure 16B:
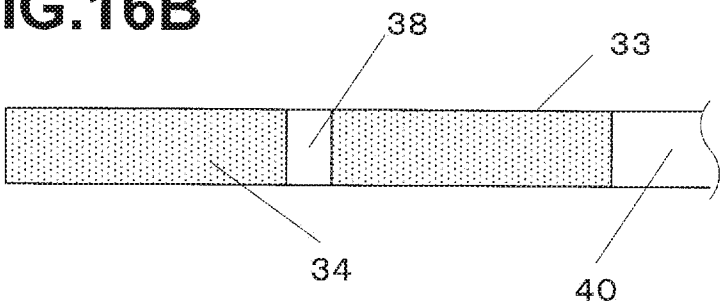
FIGS. 16A to 16D illustrate the configuration of a slit ring 30 according to a different example.
Figure 16C:
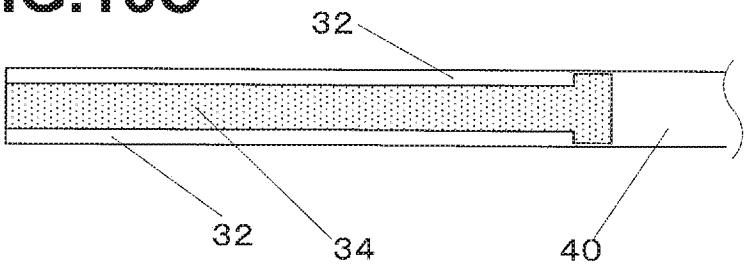
Figure 16D:
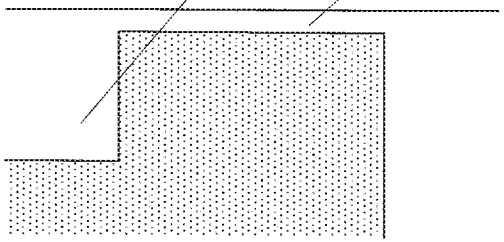
Figure 16A:
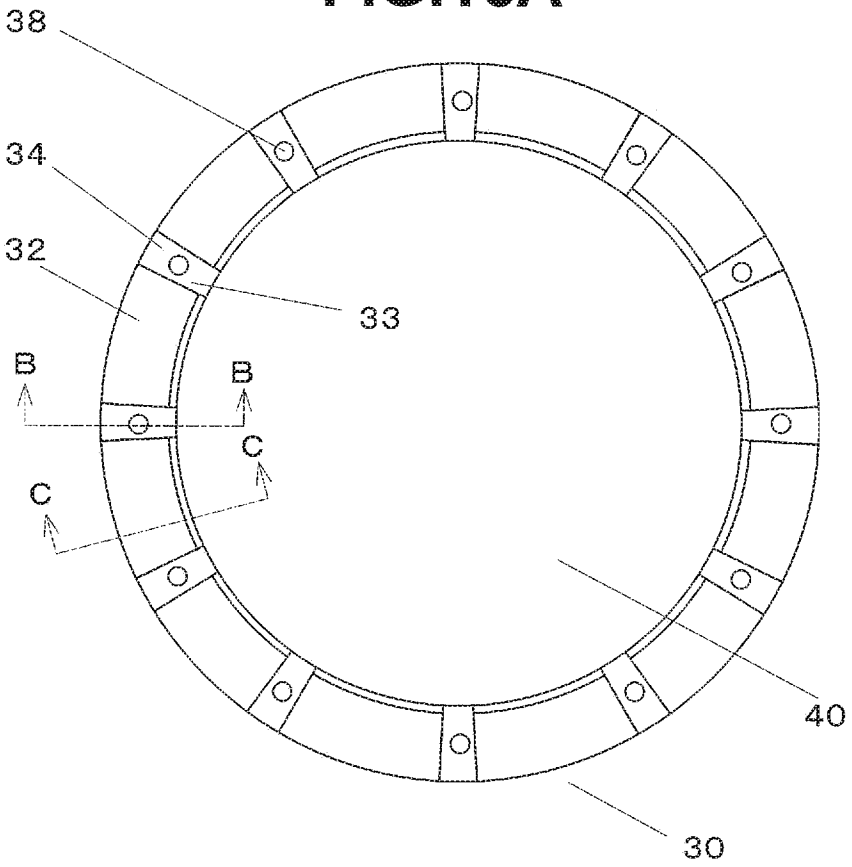
Figure 17:
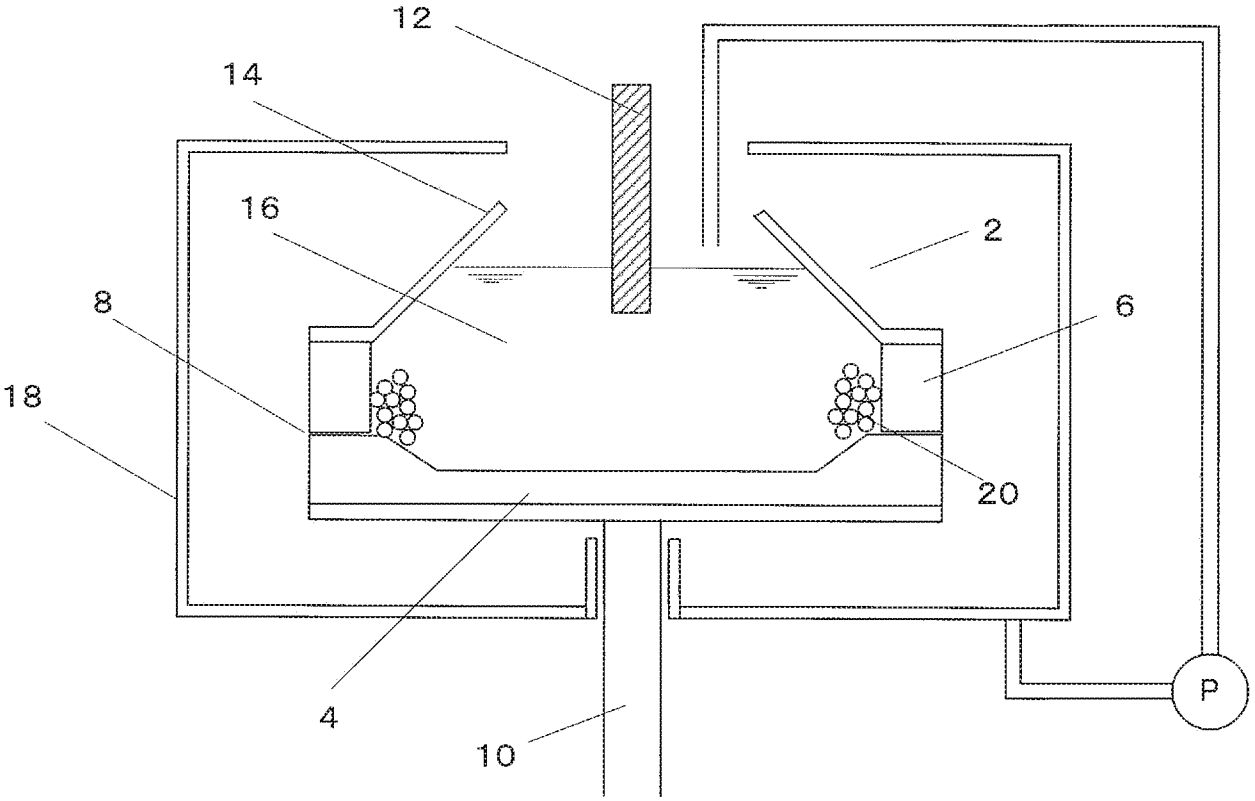
FIG. 17 is a sectional view of a rotational treating device according to the related art.

As illustrated in FIG. 16D, a minute recessed portion 35 formed to be slightly lower than the thickest portion 33 is formed at the inner periphery. In this example, a gap formed by the minute recessed portion 35 is the same as the gap which is formed by the spacer ring 5.

Such a configuration eliminates the need to use the spacer ring 5, which facilitates assembly.

(2) In the embodiment described above, the gap 8 is provided on both the upper and lower sides of the slit ring 30. However, the gap 8 may be provided on only one of the upper and lower sides thereof.

(3) In the embodiment described above, the spacer ring 5 and the cover member 70 are constituted of a non-conductive member. However, a part or all of such members may be constituted of a conductive member to function as a cathode.

(4) In the embodiment described above, electroplating is performed as the surface treatment. However, the present invention is also applicable to other common surface treatments in which electrodes are used.

(5) In the embodiment described above, one slit ring 30 is provided on each of the upper and lower sides of the cathode ring 50. However, one slit ring 30 may be provided on only one of the upper and lower sides of the cathode ring 50. Alternatively, a plurality of slit rings 30 may be provided in layers. In this case, a gap 8 is preferably provided between the slit rings 30.

Figure 8:
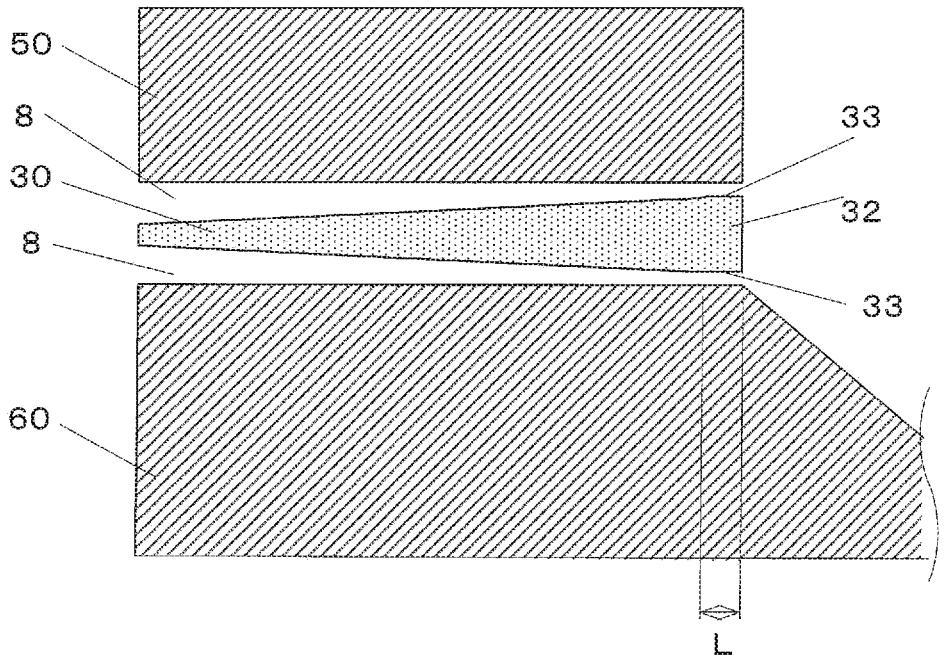
FIG. 8 illustrates a different embodiment.

(6) In the embodiment described above, the gaps 8 are configured to be stepped as illustrated in FIG. 5B. However, the gaps 8 may be configured to gradually become wider toward the outer side as illustrated in FIG. 8.

Figure 9:
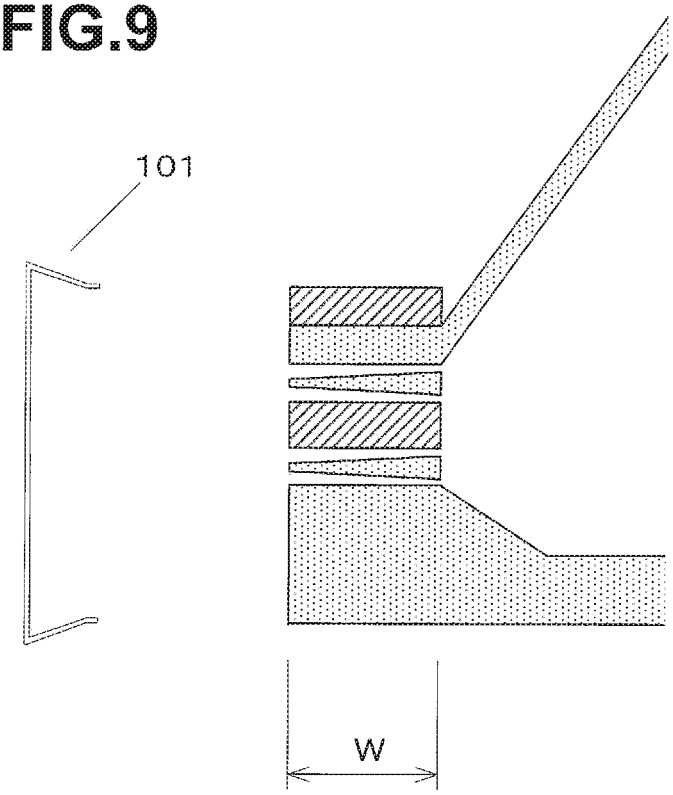
FIG. 9 illustrates a different embodiment.

(7) In the embodiment described above, the various members are provided with through holes, and fixed to each other by bolts and nuts. However, such members may be stacked on and fixed to each other by being clamped by a springy member 101 as illustrated in FIG. 9. In this case, there is no need for through holes. In order to fix the treatment bath 2 to the base member 90, screw holes may be provided in the bottom surface of the bottom surface member 60, and the treatment bath 2 may be fixed by bolts via through holes provided in the base member 90.

In the case where the fixing method illustrated in FIG. 9 is adopted, there is no need for through holes, and therefore an overall width W of the side wall 80 can be reduced. Thus, by making the overall width W equal to or smaller than the length L of the thickest portion 33 in FIG. 5B, the same effect as that of the embodiment described above can be obtained by providing only the narrow gap 8 (providing only the portion for the length L in FIG. 5B). The overall width W is preferably equal to or less than 50 times the minimum dimension of the objects to be treated.

Figure 10:
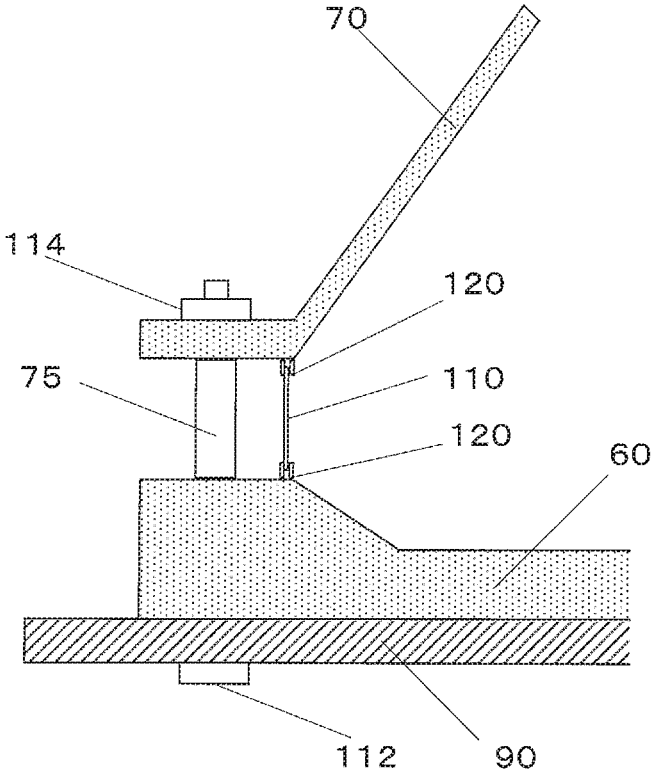
FIG. 10 illustrates a different embodiment.

(8) In the embodiment described above, the side wall 80 is formed by stacking the members on each other. However, as illustrated in FIG. 10, the side wall 80 may be formed by a slit member 110 in a sheet shape as illustrated in FIG. 10.

The slit member 110 is held with its upper and lower sides clamped by holders 120 provided to the cover member 70 and the bottom surface member 60. The base member 90, the bottom surface member 60, and the cover member 70 are fixed to each other by bolts 112 and nuts 114 together with cylindrical spacers 75 interposed between the bottom surface member 60 and the cover member 70.

Figure 11A:
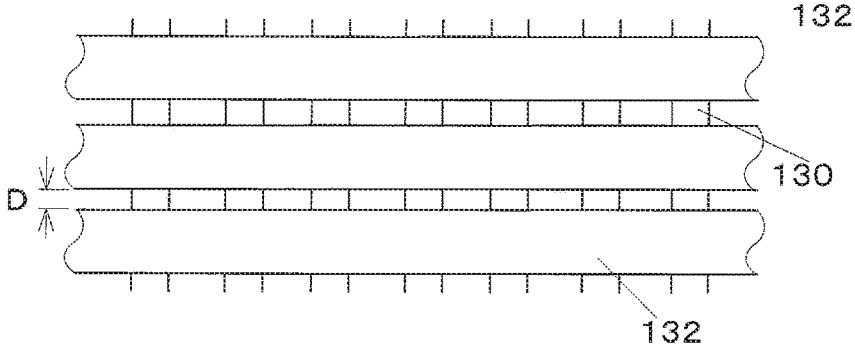
FIGS. 11A to 11C illustrate the details of a slit member 110.
Figure 11C:
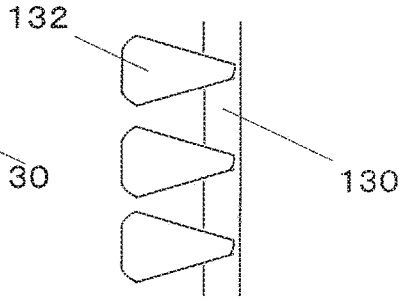
Figure 11B:
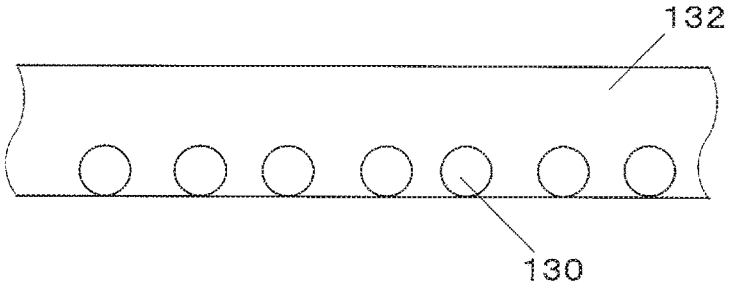

FIG. 11 illustrates the partial details of the slit member 110. FIG. 11A is a front view, FIG. 11B is a bottom view, and FIG. 11C is a side view. The slit member 110 is formed from support rods 130 provided to stand upright in proximity to each other, and wire materials 132 with a wedge-shaped cross section fixed to the support rods 130. A clearance D between the head portions of adjacent wire materials 132 is 30% to 80% (preferably 40% to 60%) of the minimum dimension (the smallest of the length, width, and height) of the parts 20 to be treated.

The wire materials 132 are attached such that their head portions (widest portions) are directed toward the inner side of the treatment bath 2 during use. This allows the plating liquid 16 to be drained while keeping the parts 20 in the treatment bath 2. In addition, the use of the wedge-shaped wire materials 132 can reduce the drain resistance. When the slit member 110 is formed from a conductive material, the slit member 110 can also serve as a cathode.

A Fine Wedge (registered trademark) from Manabe Kogyo Co., Ltd. can be used as the slit member 110.

Figure 12:
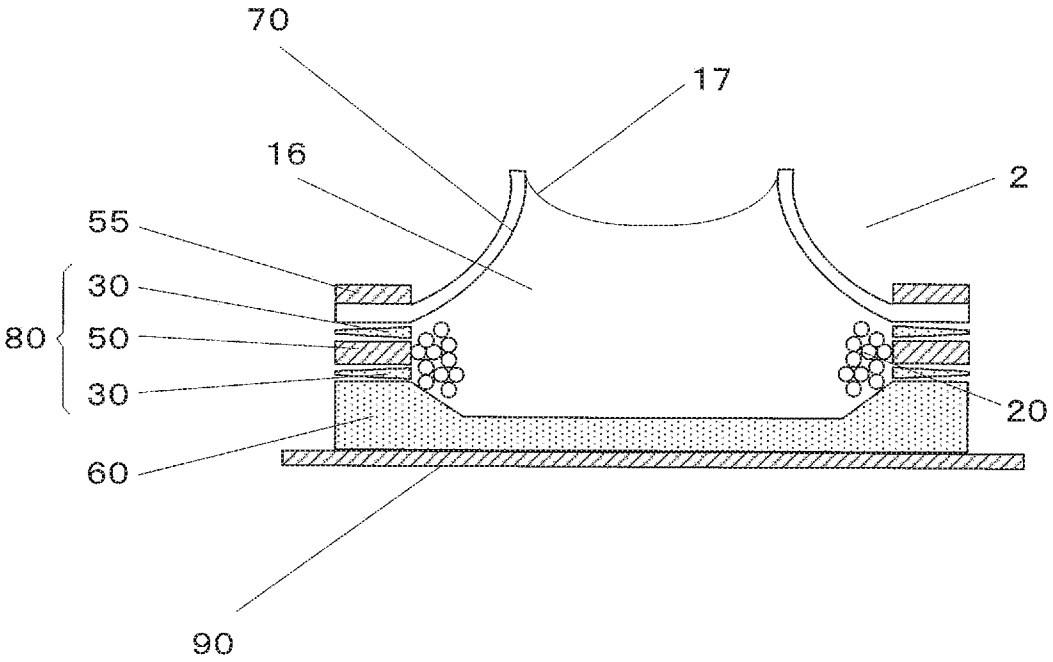
FIG. 12 illustrates a different embodiment.

(9) In the embodiment described above, water is drained through only the gaps 8 in the side wall 80. However, as illustrated in FIG. 12, water may be drained by increasing the rotational speed only during drainage (or lowering the cover member 70 only during drainage) so that the water surface of the plating liquid 16 is above the cover member 70. This increases the drain rate when used in combination with drainage through the gaps 8 in the side wall 80. In this event, the cover member 70 is preferably shaped such that only the plating liquid 16, and not the parts 20, is discharged through the upper portion.

(10) In the embodiment described above, the gap 8 which is wider on the outer side is provided. However, a part or all of the gap 8 may be filled with a porous member. If pores of the porous member are smaller than the minimum dimension of the targets to be treated, the size of the gap 8 can be larger than the minimum dimension of the objects to be treated. In this case, the porous member is preferably provided at least on the inner side against which the objects to be treated abut.

(11) A surface treating device has been described in relation to the embodiment described above. However, the present invention is also applicable to processes (such as an internal treatment) other than the surface treatment.

EXAMPLE

Figure 13A:
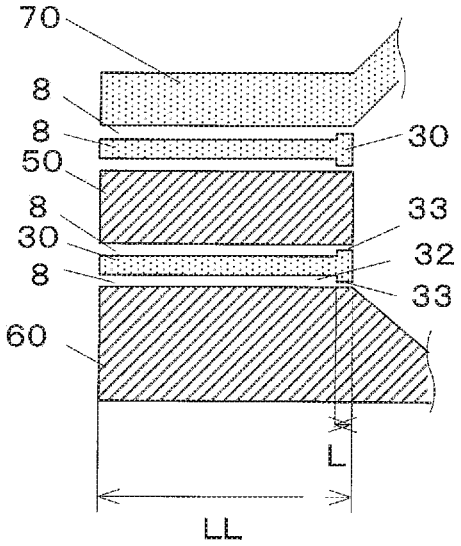
FIGS. 13A and 13B illustrate the structure according to the embodiment and the structure according to the related art for comparison.
Figure 13B:
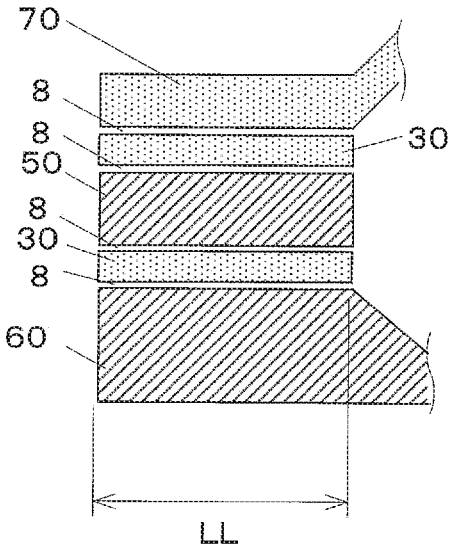

An experiment was conducted to compare the drain rates for the structure according to the related art and the structure according to the present invention. An experiment was conducted to compare the drain rates for the structure according to the related art, in which the slit rings 30 were not provided with recessed portions as illustrated in FIG. 13B, and the structure according to the present invention, in which the slit rings 30 were provided with the recessed portions 32 (0.5 mm) as illustrated in FIG. 13A.

The bottom surface member 60 had a diameter of 280 mm. The cathode ring 50 had a thickness of 5 mm. The gaps 8 were 0.05 mm. The slit rings 30 had a width LL of 30 mm. The thickest portions 33 had a width L of 3.0 mm. In the experiment, the treatment bath 2 was filled with 2.2 liters of water, and the treatment bath 2 was rotated at a rotational speed of 405 rpm to measure the drain rate.

FIG. 14A indicates the measured drain rates. A drain rate of as much as about 15 times that obtained with the structure according to the related art was obtained with the structure according to the present invention.

Figure 15A:
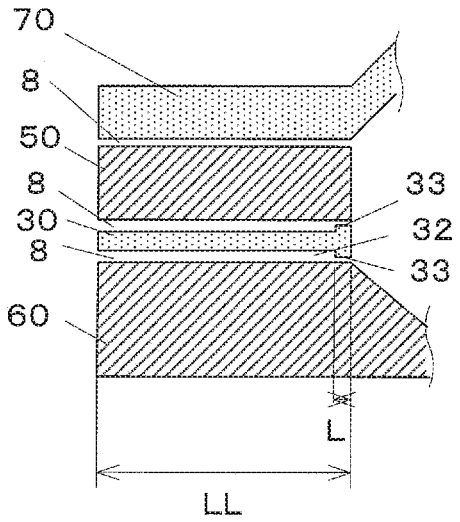
FIGS. 15A and 15B illustrate variations of the structure according to the embodiment.
Figure 15B:
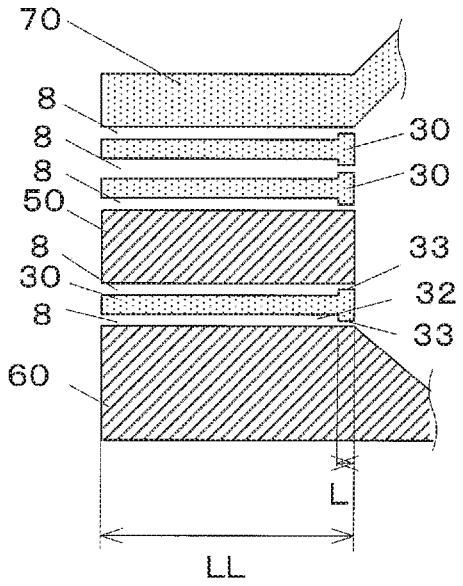

An experiment was conducted also for a case where the slit ring 30 according to the present invention was provided only on the lower side as illustrated in FIG. 15A and a case where two slit rings 30 were provided on the upper side and one slit ring 30 was provided on the lower side as illustrated in FIG. 15B.

FIG. 14B indicates the measured drain rates. A drain rate of about 12 times that obtained with the structure according to the related art was obtained in the case where the slit ring 30 was provided only on the lower side. No significant difference was found between the case where one slit ring 30 was provided on each of the upper and lower sides and the case where two slit rings 30 were provided on the upper side and one slit ring 30 was provided on the lower side.

A general description of the present invention as well as preferred embodiments of the invention has been set forth above. It is to be expressly understood, however, the terms described above are for purpose of illustration only and are not intended as definitions of the limits of the invention. Those skilled in the art to which the present invention pertains will recognize and be able to practice other variations in the system, device, and methods described which fall within the teachings of this invention. Accordingly, all such modifications are deemed to be within the scope of the invention.

What is claimed is:

1. A rotational plating device comprising:

a treatment bath including a side wall and a bottom surface, and that is configured to accommodate a treatment liquid and objects to be plated; and a rotating mechanism configured to rotate the treatment bath such that the objects to be plated receive a centrifugal force toward the side wall, wherein:

the side wall is provided with a gap that allows the treatment liquid to be discharged by the centrifugal force due to rotation of the treatment bath, wherein the gap is oriented to extend from an inner side of the side wall to an outer side of the side wall in a direction generally perpendicular to an axis of rotation of the rotational plating device; and the gap of the side wall is formed to be smaller than a minimum outer dimension of the objects to be plated on the inner side of the side wall which is contacted by the objects to be plated, and the gap on the side wall is formed to be larger than the minimum outer dimension of the objects on an outer side of the side wall, wherein:

the side wall is constituted by stacking hollow disks on each other; and the gap is formed by interposing a spacer between adjacent hollow disks, and the hollow disks are formed to be thinner on the outer side than on the inner side.

2. The rotational treating device according to claim 1, wherein:

a second electrode is provided as at least a part of the side wall; and a first electrode is provided so as to contact the treatment liquid.

3. A rotational plating device comprising:

a treatment bath including a side wall and a bottom surface, and that is configured to accommodate a treatment liquid and objects to be plated; and a rotating mechanism configured to rotate the treatment bath such that the objects to be plated receive a centrifugal force toward the side wall, wherein:

the side wall is provided with a gap that allows the treatment liquid to be discharged by the centrifugal force due to rotation of the treatment bath, wherein the gap is oriented to extend from an inner side of the side wall to an outer side of the side wall in a direction generally perpendicular to an axis of rotation of the rotational plating device; and the gap of the side wall is formed to be smaller than a minimum outer dimension of the objects to be plated on the inner side of the side wall which is contacted by the objects to be plated, and the gap on the side wall is formed to be larger than the minimum outer dimension of the objects on an outer side of the side wall, wherein the side wall is constituted by disposing wedge-shaped members with wider portions of the wedge-shaped members directed inward and fixing the wedge-shaped members to a support member with a gap provided between adjacent wedge-shaped members.

4. A rotational plating device comprising:

a treatment bath including a side wall and a bottom surface, and that is configured to accommodate a treatment liquid and objects to be plated; and a rotating mechanism configured to rotate the treatment bath such that the objects to be plated receive a centrifugal force toward the side wall, wherein:

the side wall is provided with a gap that allows the treatment liquid to be discharged by the centrifugal force due to rotation of the treatment bath, wherein the gap is oriented to extend from an inner side of the side wall to an outer side of the side wall in a direction generally perpendicular to an axis of rotation of the rotational plating device; and a porous member is provided in the gap on at least the inner side of the side wall which is contacted by the objects to be plated, and the gap in the side wall is formed to be larger on an outer side of the side wall than on the inner side of the side wall, wherein:

the side wall is constituted by stacking hollow disks on each other; and the gap is formed by interposing a spacer between adjacent hollow disks, and the hollow disks are formed to be thinner on the outer side than on the inner side.

5. The rotational treating device according to claim 4, wherein:

a second electrode is provided as at least a part of the side wall; and a first electrode is provided so as to contact the treatment liquid.

6. A rotational plating device comprising:

a treatment bath including a side wall and a bottom surface, and that is configured to accommodate a treatment liquid and objects to be plated; and a rotating mechanism configured to rotate the treatment bath such that the objects to be plated receive a centrifugal force toward the side wall, wherein:

the side wall is provided with a gap that allows the treatment liquid to be discharged by the centrifugal force due to rotation of the treatment bath, wherein the gap is oriented to extend from an inner side of the side wall to an outer side of the side wall in a direction generally perpendicular to an axis of rotation of the rotational plating device; and a porous member is provided in the gap on at least the inner side of the side wall which is contacted by the objects to be plated, and the gap in the side wall is formed to be larger on an outer side of the side wall than on the inner side of the side wall, wherein the side wall is constituted by disposing wedge-shaped members with wider portions of the wedge-shaped members directed inward and fixing the wedge-shaped members to a support member with a gap provided between adjacent wedge-shaped members.

* * * * *